US012722033B2

(12) United States Patent
Lu

(10) Patent No.: US 12,722,033 B2
(45) Date of Patent: Sep. 1, 2026

(54) TRAMPOLINE

(71) Applicant: Xiaoqiang Lu, Zhejiang (CN)

(72) Inventor: Xiaoqiang Lu, Zhejiang (CN)

( * ) Notice: Subject to any disclaimer, the term of this patent is extended or adjusted under 35 U.S.C. 154(b) by 0 days.

(21) Appl. No.: 19/574,112

(22) Filed: Mar. 20, 2026

(65) Prior Publication Data

US 2026/0216552 A1 Jul. 30, 2026

Related U.S. Application Data

(63) Continuation-in-part of application No. 18/916,734, filed on Oct. 16, 2024, now abandoned.

(30) Foreign Application Priority Data

Jul. 13, 2024 (CN) ..... 202410938439.2

(51) Int. Cl.
*A63B 5/11* (2006.01)

(52) U.S. Cl.
CPC ..... *A63B 5/11* (2013.01); *A63B 2210/50* (2013.01)

(58) Field of Classification Search
None
See application file for complete search history.

(56) References Cited

U.S. PATENT DOCUMENTS 1,950,603 A * 3/1934 Fischer ..... A47D 13/065 256/25
2,590,049 A * 3/1952 Sidlinger ..... A63B 5/11 482/28
2,858,132 A * 10/1958 Sidlinger ..... A63B 5/11 482/28
4,070,716 A * 1/1978 Satt ..... A47D 13/063 5/99.1
4,186,454 A * 2/1980 Cone ..... A47D 13/063 5/99.1
D287,909 S * 1/1987 Weiss ..... D6/382
5,363,521 A * 11/1994 Garland ..... A47D 13/063 5/98.1

(Continued)

FOREIGN PATENT DOCUMENTS

CN 108656089 A * 10/2018 ..... B25J 9/0045
CN 213131717 U * 5/2021

(Continued)

*Primary Examiner* — Shila Jalalzadeh Abyaneh
(74) *Attorney, Agent, or Firm* — Birchwood IP

(57) ABSTRACT

Disclosed is a trampoline, including a jumping surface and a foldable bed frame, where the foldable bed frame includes a frame body and a support assembly. A connecting base is arranged between two adjacent side rods, and each side rod includes two section rods, where proximal ends of the two section rods are pivotally connected to each other, and distal ends of the two section rods are pivotally connected to corresponding connecting bases respectively. A supporting base is arranged below each of the connecting bases. Each support assembly includes two support rods, upper ends of the two support rods are pivotally connected to corresponding connecting bases respectively, and lower ends of the two support rods are pivotally connected to corresponding supporting bases respectively. The jumping surface is located inside the frame body, and peripheral edges of the jumping surface are connected to the frame body.

8 Claims, 9 Drawing Sheets

(56) References Cited

U.S. PATENT DOCUMENTS

| | | | | |
|---|---|---|---|---|
| 6,438,773 | B1 * | 8/2002 | Hsia | A47D 13/063 5/98.1 |
| 6,499,705 | B1 * | 12/2002 | Tsai | F16M 11/22 248/167 |
| 6,708,630 | B2 * | 3/2004 | Zheng | A47B 3/02 108/115 |
| 8,047,967 | B1 * | 11/2011 | Teng | A63B 5/11 482/28 |
| 8,282,509 | B1 * | 10/2012 | Michaelson | A63B 69/36 473/456 |
| 8,424,470 | B2 * | 4/2013 | Volin | A47B 3/091 108/118 |
| 9,103,368 | B2 * | 8/2015 | Mendes | F16C 11/10 |
| 10,099,711 | B1 * | 10/2018 | Sun | B62B 3/007 |
| 11,266,253 | B1 * | 3/2022 | Flannery | A47D 9/005 |
| 11,330,916 | B1 * | 5/2022 | Zhang | E04H 17/18 |
| 12,233,316 | B2 * | 2/2025 | Weinast | A63B 21/0428 |
| 2003/0061658 | A1 * | 4/2003 | Longenecker | A47D 13/063 5/99.1 |
| 2005/0166316 | A1 * | 8/2005 | Gehr | A47D 13/063 5/99.1 |
| 2016/0045775 | A1 * | 2/2016 | Zhou | A63B 5/11 482/27 |

FOREIGN PATENT DOCUMENTS

| | | | | | |
|---|---|---|---|---|---|
| CN | 113080654 | A | * | 7/2021 | A47D 7/00 |
| CN | 114849132 | A | * | 8/2022 | A63B 5/11 |
| CN | 217162986 | U | * | 8/2022 | |
| KR | 101836036 | B1 | * | 3/2018 | A63B 5/11 |
| KR | 102146074 | B1 | * | 8/2020 | A63B 71/0622 |
| WO | WO-2017002332 | A1 | * | 1/2017 | A63B 5/11 |

* cited by examiner

TRAMPOLINE

TECHNICAL FIELD

The present disclosure relates to the technical field of trampolines, and particularly relates to a foldable trampoline.

BACKGROUND OF THE INVENTION

A Chinese invention patent with the Publication No. CN217645741U discloses a foldable hexagonal trampoline. The hexagonal trampoline includes a hexagonal frame, a jumping mat, supporting legs installed below the frame, and handrails mounted on the frame, where the jumping mat is located in an enclosed area of the frame and connected with the frame through an elastic rope, and the frame is formed by connecting four sets of identical pipes through two sets of vertical movable members and two sets of horizontal movable members. The two sets of vertical movable members are arranged at midpoints of opposite sides of the frame, and the two sets of horizontal movable members are arranged at diagonal points of the frame. When the hexagonal trampoline is folded, the jumping mat, the supporting legs, the handrails and the elastic rope need to be disassembled first, then the hexagonal frame is folded in half through the vertical movable members, and finally the folded-in-half hexagonal frame retracts inward through the horizontal movable members. Therefore, the entire folding process is relatively cumbersome and not convenient or efficient. Further, like upright rods, the supporting legs of the hexagonal trampoline are arranged at six corners of the hexagonal frame in a dispersed manner, and a span between every two supporting legs is relatively large. Therefore, stability of support in use is insufficient, and particularly when a user jumps near a side edge of the trampoline, the supporting legs are likely to be bent or broken due to stress imbalance.

BRIEF SUMMARY OF THE INVENTION

In order to overcome the defects in the prior art, an objective of the present disclosure is to provide a foldable trampoline that is convenient and efficient to fold and unfold, occupies minimal space due to a small volume after folding, and has high stability of support in use.

The objective of the present disclosure is achieved through the following technical solution:

A trampoline, including a jumping surface and a foldable bed frame, where the foldable bed frame includes a frame body formed by a plurality of side rods in a surrounding manner, and a support assembly arranged below each of the side rods; a connecting base is arranged between two adjacent side rods, and each of the side rods includes two section rods, where proximal ends of the two section rods are pivotally connected to each other, and distal ends of the two section rods are pivotally connected to corresponding connecting bases respectively; a supporting base is arranged below each of the connecting bases; each of the support assemblies includes two support rods that are pivotally connected in an X-shaped and crossed manner, upper ends of the two support rods are pivotally connected to corresponding connecting bases respectively, and lower ends of the two support rods are pivotally connected to corresponding supporting bases respectively; the jumping surface is located inside the frame body, and peripheral edges of the jumping surface are connected to the frame body through a plurality of connecting members; when the foldable bed frame is folded, the proximal ends of the two section rods of each of the side rods move upward, the distal ends of the two section rods of each of the side rods move closer to each other, and the two support rods of each of the support assemblies also move closer to each other; and when the distal ends of the two section rods of each of the side rods move closer to each other, the two section rods of each of the side rods and the two support rods of each of the support assemblies also move toward a center of the trampoline, and the jumping surface and the connecting members are folded inward.

Further, the frame body is a regular polygon frame body formed by a plurality of equal-length side rods in a surrounding manner, and peripheral edges of the jumping surface are connected to the two section rods of each of the side rods through the plurality of connecting members.

Further, each of the supporting bases is located directly below one corresponding connecting base, and a supporting plane suitable for contact with the ground is arranged at a bottom of each of the supporting bases.

Further, a pivot connection position between the proximal ends of the two section rods of each of the side rods is aligned vertically with a pivot connection position between the two support rods of one corresponding support assembly.

Further, pivot connection positions of the distal ends of the two section rods of each of the side rods are aligned vertically with pivot connection positions for upper ends of and pivot connection positions for lower ends of the two support rods of one corresponding support assembly respectively.

Further, the two section rods of each of the side rods are line-shaped when they are unfolded.

Further, the two section rods of each of the side rods are defined as a first section rod and a second section rod respectively, where one end of the first section rod close to the second section rod is provided with a first pivot connection piece, and one end of the second section rod close to the first section rod is provided with a second pivot connection piece; the first pivot connection piece comprises a first inserted connection portion that is inserted into and fixedly connected to an end portion of the first section rod, a first circular pivot connection portion exposed outside the end portion of the first section rod, a first arc-shaped concave portion that is located on a side of the first circular pivot connection portion close to the first inserted connection portion and extends outward in an axial direction of the first circular pivot connection portion, a first sector-shaped limiting block that is arranged on an outer surface of the first circular pivot connection portion in a protruding manner and is close to the first arc-shaped concave portion, and a first sector-shaped limiting groove that is concavely formed on the outer surface of the first circular pivot connection portion and is away from the first arc-shaped concave portion, wherein one end of the first sector-shaped limiting groove is provided with a vertical first end wall, and the other end of the first sector-shaped limiting groove is provided with a horizontal second end wall; the second pivot connection piece comprises a second inserted connection portion that is inserted into and fixedly connected to an end portion of the second section rod, a second circular pivot connection portion that is exposed outside the end portion of the second section rod and arranged with the first circular pivot connection portion in a staggered manner, a second arc-shaped concave portion that is located on a side of the second circular pivot connection portion close to the second inserted connection portion and extends inward in an axial direction of the second circular pivot connection portion, a second sector-shaped limiting block that is arranged on an inner surface of the second circular pivot connection portion in a protruding manner and is close to the second arc-shaped concave portion, and a second sector-shaped limiting groove that is concavely formed on the inner surface of the second circular pivot connection portion and is away from the second arc-shaped concave portion, wherein one end of the second sector-shaped limiting groove is provided with a vertical third end wall, and the other end of the second sector-shaped limiting groove is provided with a horizontal fourth end wall; the first circular pivot connection portion and the second circular pivot connection portion are arranged side by side and pivotally connected through a pin, the first arc-shaped concave portion is slidably fitted with an outer circular surface of the second circular pivot connection portion, and the second arc-shaped concave portion is slidably fitted with an outer circular surface of the first circular pivot connection portion, wherein the first sector-shaped limiting block is inserted into and slidably matched with the second sector-shaped limiting groove, and the second sector-shaped limiting block is inserted into and slidably matched with the first sector-shaped limiting groove; when the two section rods of each of the side rods are folded, the first arc-shaped concave portion slides to a lower side of the outer circular surface of the second circular pivot connection portion, the second arc-shaped concave portion slides to a lower side of the outer circular surface of the first circular pivot connection portion, the first sector-shaped limiting block slides to a position where its top abuts against the fourth end wall, and the second sector-shaped limiting block slides to a position where its top abuts against the second end wall; and when the two section rods of each of the side rods are folded, the first arc-shaped concave portion slides to a lower side of the outer circular surface of the second circular pivot connection portion, the second arc-shaped concave portion slides to a lower side of the outer circular surface of the first circular pivot connection portion, the first sector-shaped limiting block slides to a position where its top abuts against the fourth end wall, and the second sector-shaped limiting block slides to a position where its top abuts against the second end wall.

Further, the first circular pivot connection portion, the first arc-shaped concave portion, the first sector-shaped limiting block, and the first sector-shaped limiting groove are concentrically arranged, the first sector-shaped limiting block and the first arc-shaped concave portion are parallel to each other, the first sector-shaped limiting groove is arranged relative to the first sector-shaped limiting block, a central angle of the first sector-shaped limiting block is 90 degrees, and a central angle of the first sector-shaped limiting groove is 270 degrees; and the second circular pivot connection portion, the second arc-shaped concave portion, the second sector-shaped limiting block, and the second sector-shaped limiting groove are also concentrically arranged, the second sector-shaped limiting block and the second arc-shaped concave portion are parallel to each other, the second sector-shaped limiting groove is arranged relative to the second sector-shaped limiting block, a central angle of the second sector-shaped limiting block is 90 degrees, and a central angle of the second sector-shaped limiting groove is 270 degrees.

Further, two first pivot connection grooves are symmetrically formed on both sides of an upper end of each of the connecting bases, and the two first pivot connection grooves are configured for pivotally connecting end portions of the corresponding section rods; both sides of a lower end of each of the connecting bases are provided with a second pivot connection groove inwardly arranged and a third pivot connection groove outwardly arranged, wherein the second pivot connection groove is configured for pivotally connecting an upper end of the corresponding support rod located on the relatively inner side, and the third pivot connection groove is configured for pivotally connecting an upper end of the corresponding support rod located on the relatively outer side; and both sides of each of the supporting bases are provided with a fourth pivot connection groove inwardly arranged and a fifth pivot connection groove outwardly arranged, wherein the fourth pivot connection groove is configured for pivotally connecting a lower end of the corresponding support rod located on the relatively inner side, and the fifth pivot connection groove is configured for pivotally connecting a lower end of the corresponding support rod located on the relatively outer side.

Further, the foldable bed frame further includes at least one handrail rod, a lower end of the handrail rod is detachably inserted into one corresponding set of the connecting base and the supporting base, and a handrail is arranged at an upper end of the handrail rod, where the handrail rod has a telescopic rod structure.

Compared with the prior art, the present invention has the following beneficial effects:

Firstly, the trampoline provided by the present disclosure can be folded together with the frame body without disassembly of the jumping surface, the connecting members, the support assemblies, and the handrail rod. Not only the trampoline can be folded in an easy, convenient and efficient manner, but also various components can be kept connected after folding. Therefore, the present disclosure facilitates both the storage of the trampoline after folding and the subsequent unfolding of the trampoline. Further, the trampoline occupies minimal space due to a small volume after folding, thereby facilitating outdoor use.

Secondly, in the present disclosure, each of the support assemblies has an X-shaped crossed rod structure, and two adjacent X-shaped crossed rod structures are connected through a connecting base and a supporting base, such that stability of support is high. Even when a user jumps at edges of the trampoline, the X-shaped crossed rod structure below is capable of transferring stress to other X-shaped crossed rod structures through the connecting base and the supporting base, thereby ensuring a stress balance and preventing the support assemblies from being bent or broken.

DETAILED DESCRIPTION OF THE INVENTION

The present disclosure will be further described in detail below with reference to the embodiments shown in the accompanying drawings.

Figure 1:
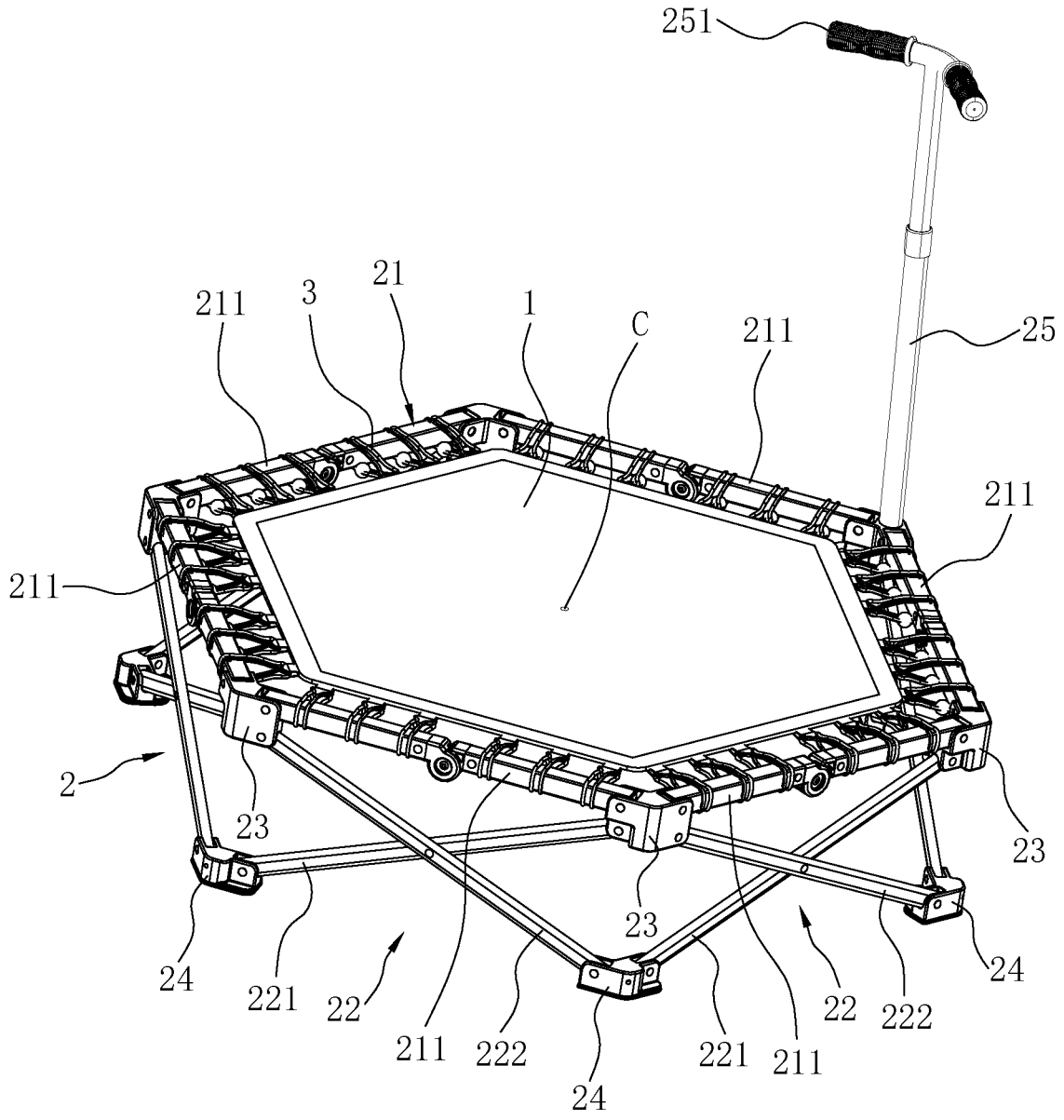
FIG. 1 is a space diagram of a trampoline in an unfolded state according to the present disclosure.
Figure 2:
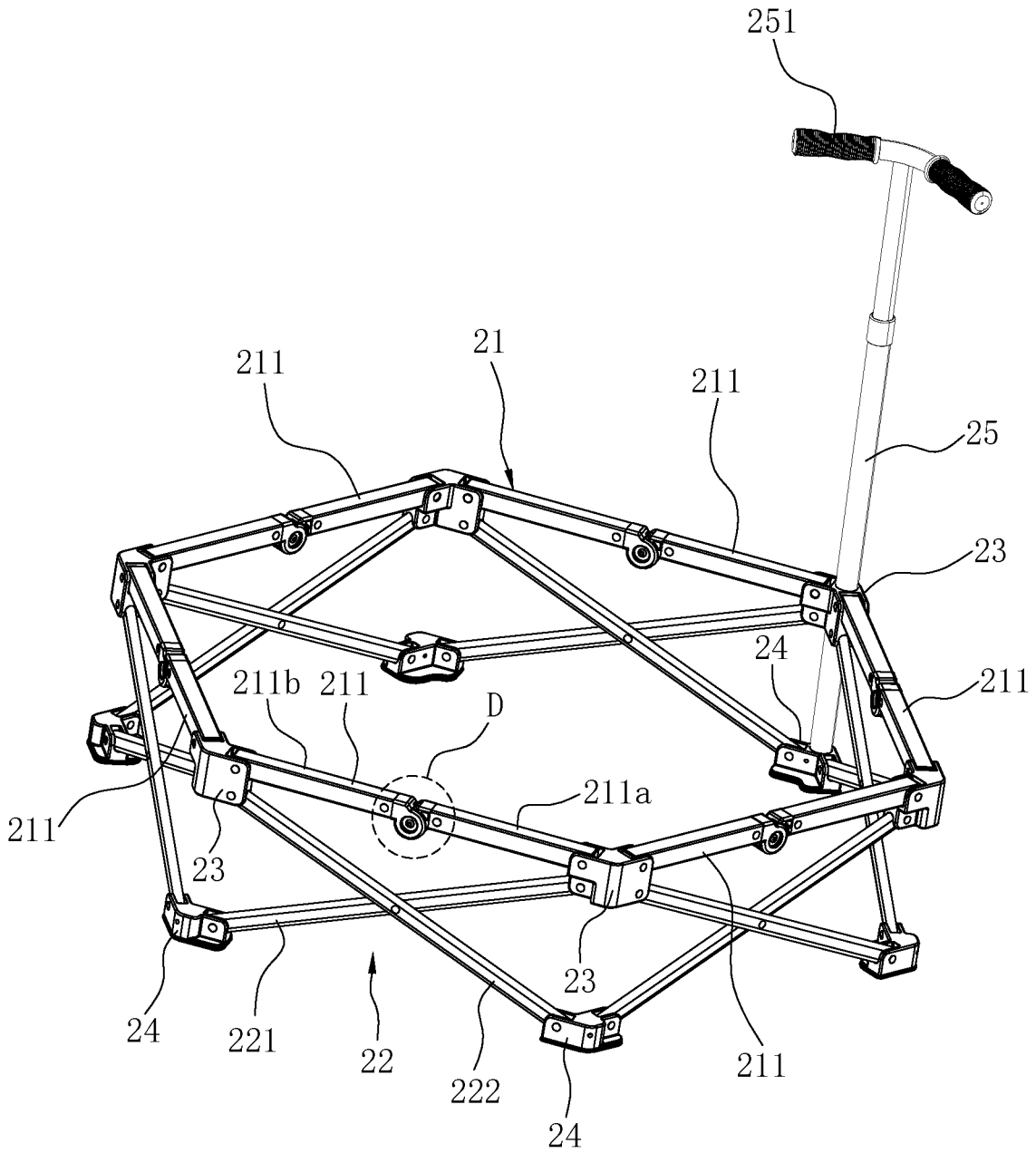
FIG. 2 is a space diagram of a foldable bed frame in an unfolded state according to the present disclosure.
Figure 3:
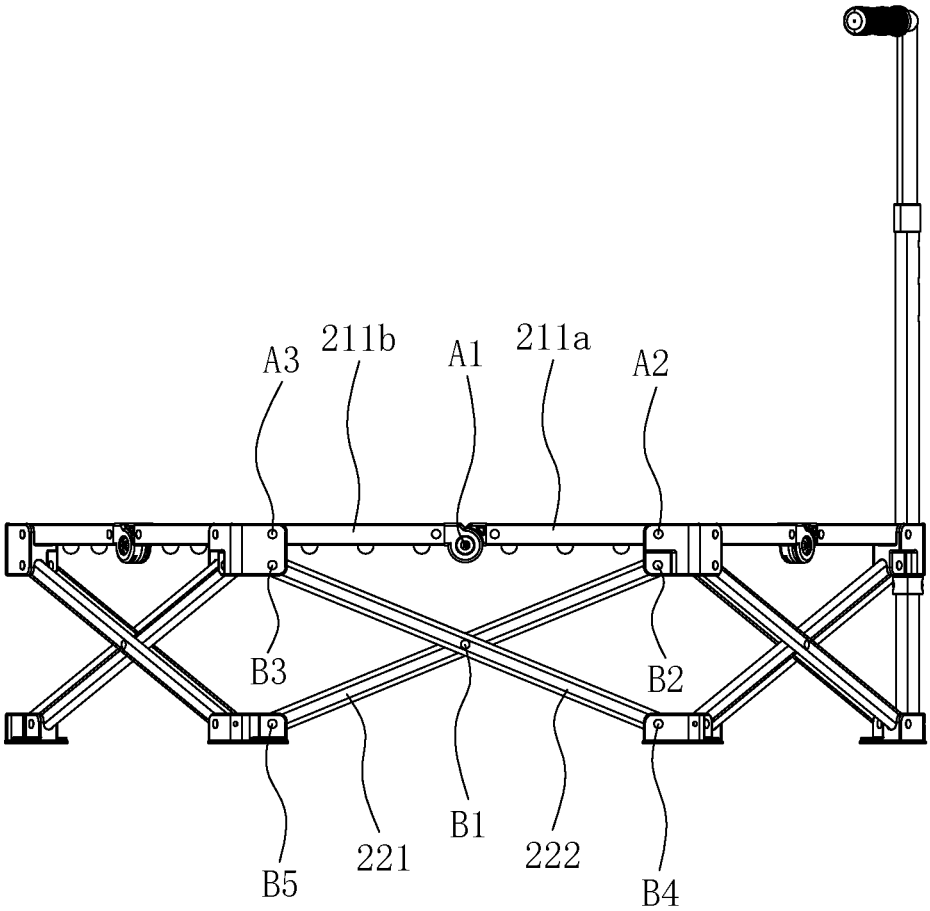
FIG. 3 is a side view of a foldable bed frame in an unfolded state according to the present disclosure.
Figure 4:
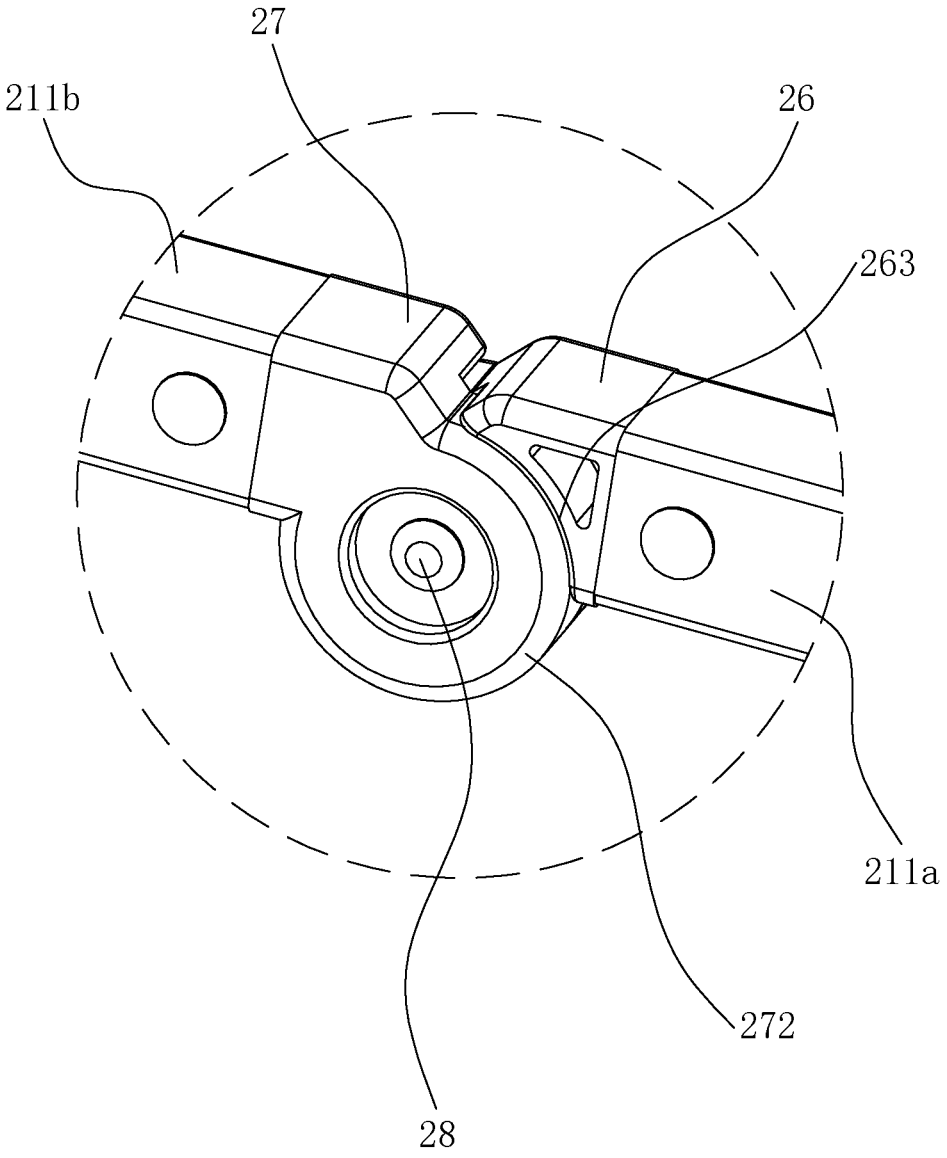
FIG. 4 is a partial enlarged view of a portion D in FIG. 2.
Figure 5:
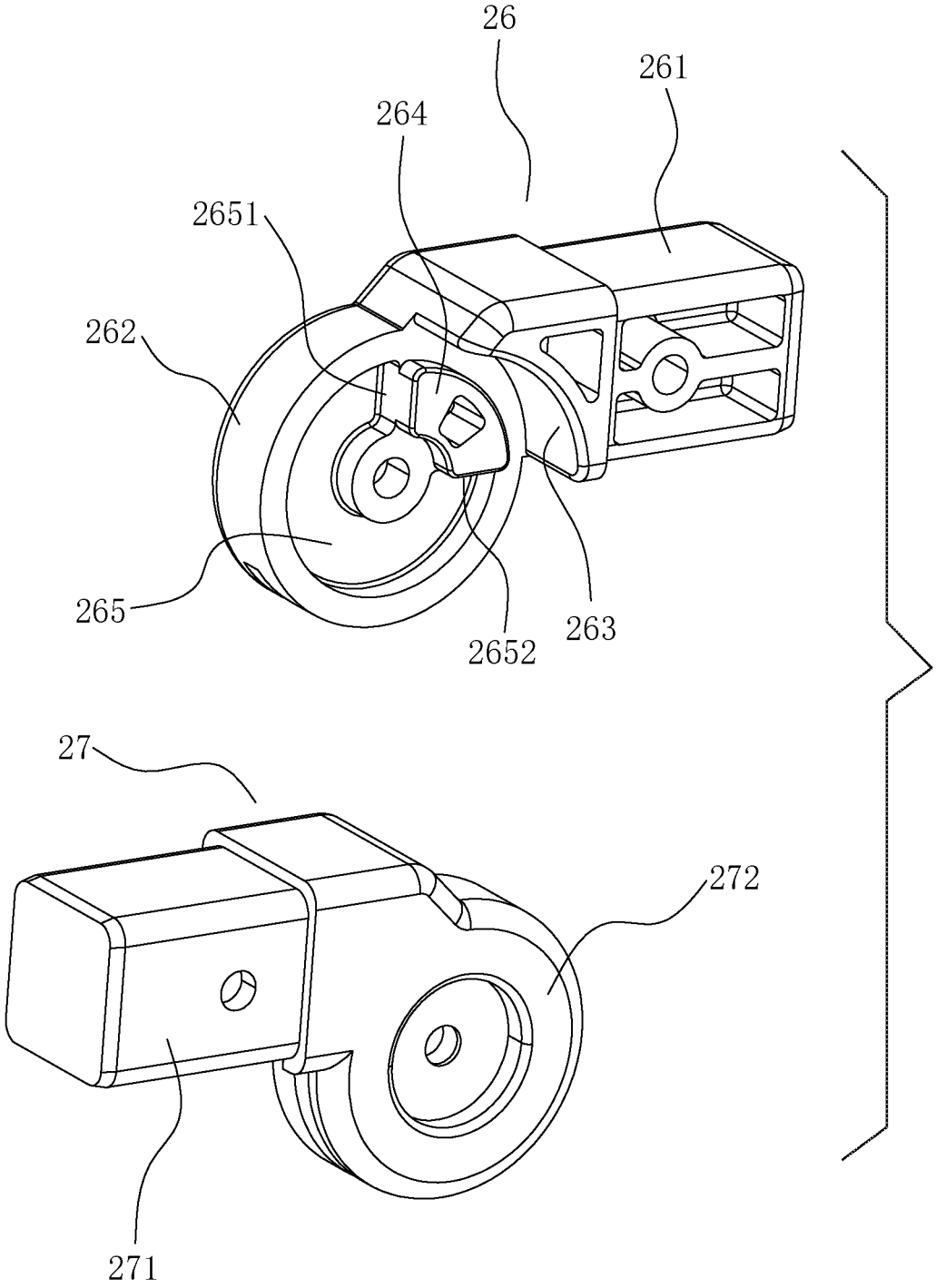
FIG. 5 is an external side view of a first pivot connection piece and a second pivot connection piece in a separated state according to the present disclosure.
Figure 6:
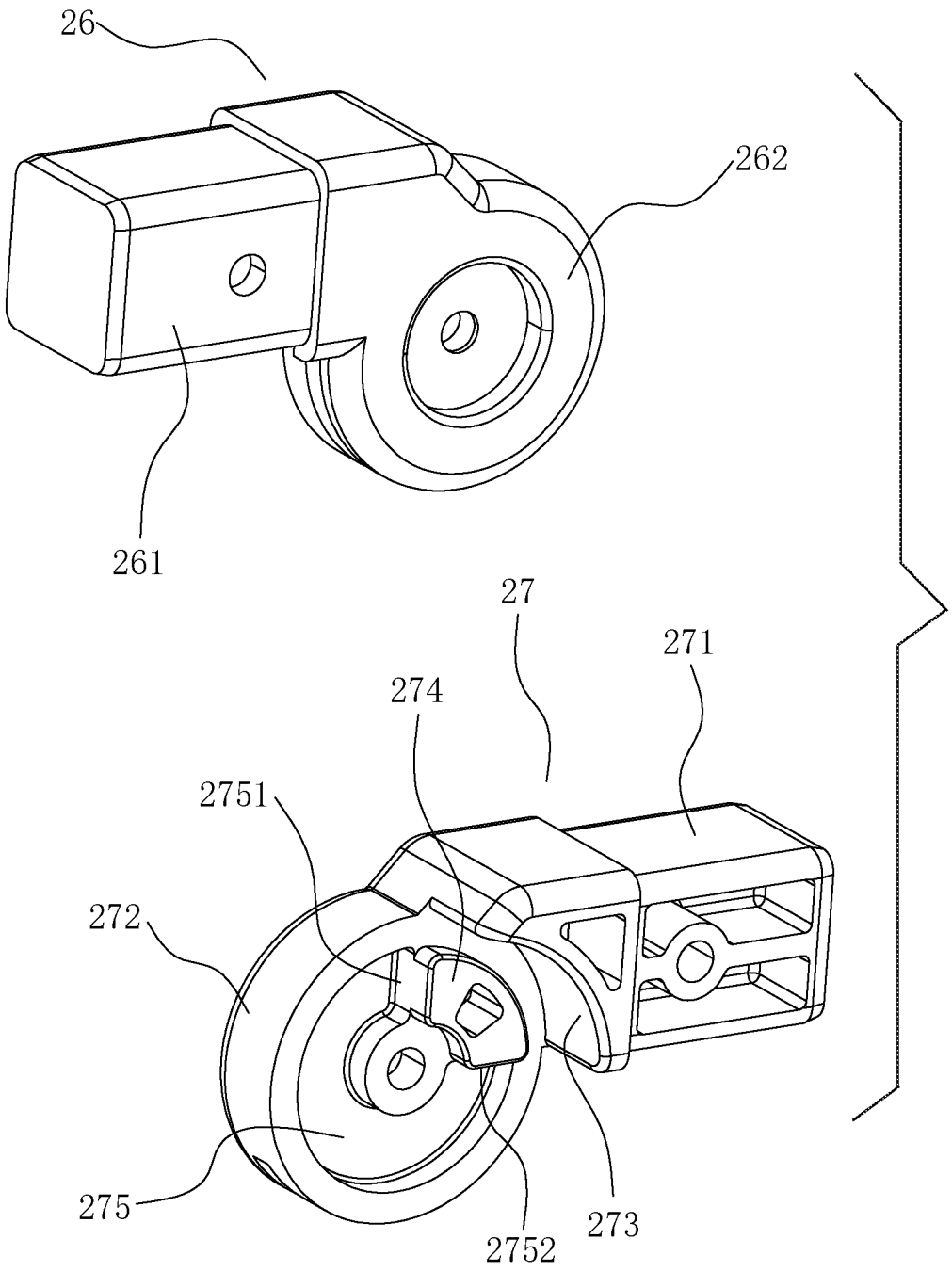
FIG. 6 is an internal side view of a first pivot connection piece and a second pivot connection piece in a separated state according to the present disclosure.
Figure 7:
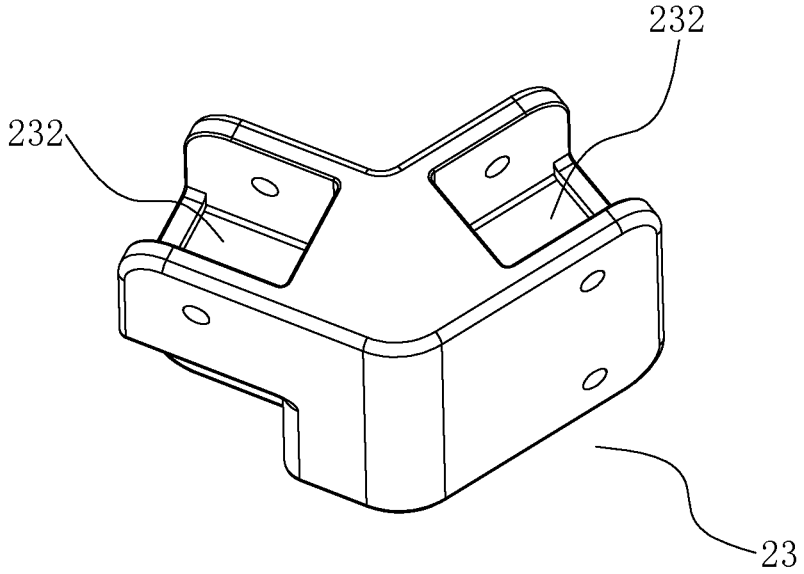
FIG. 7 is a space diagram of a top view of a connecting base according to the present disclosure.
Figure 8:
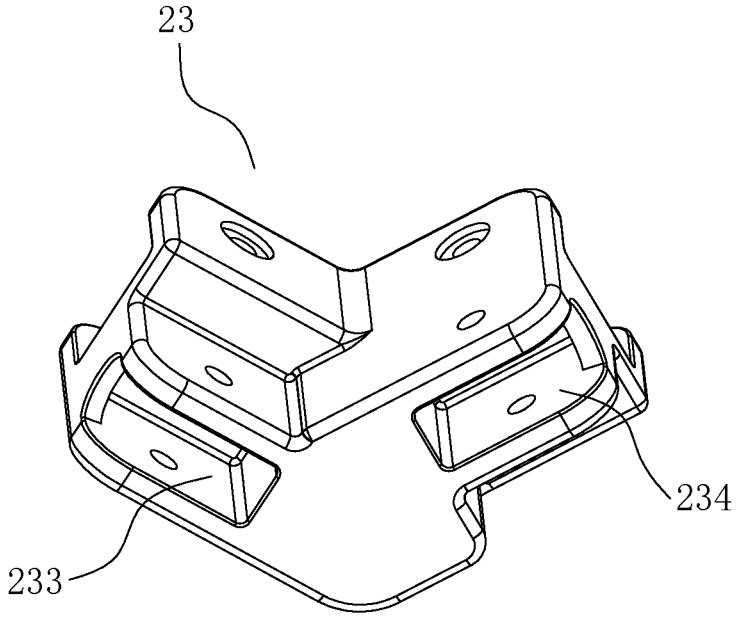
FIG. 8 is space diagram of a bottom view of a connecting base according to the present disclosure.
Figure 9:
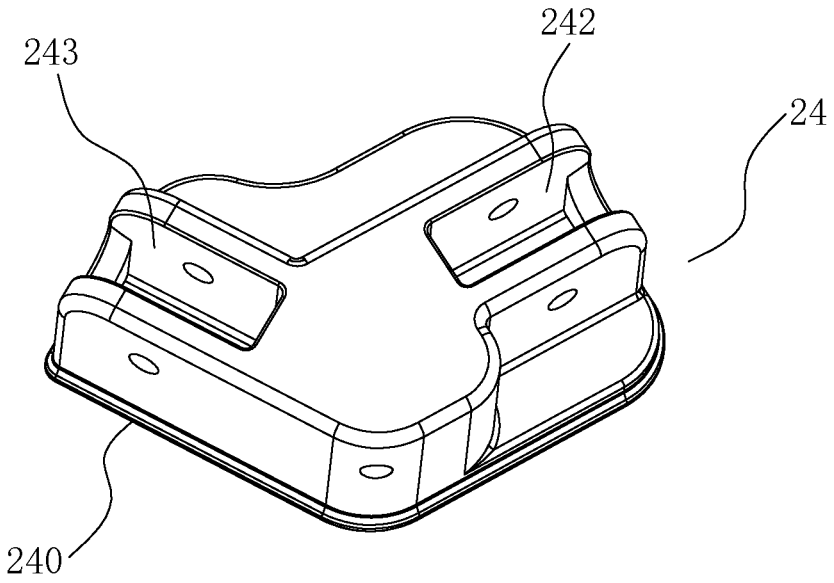
FIG. 9 is a space diagram of a top view of a supporting base according to the present disclosure.
Figure 10:
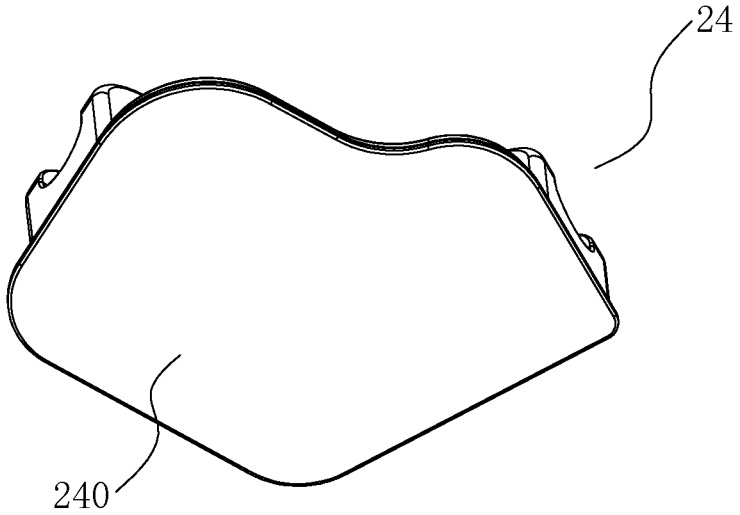
FIG. 10 is a space diagram of a bottom view of a supporting base according to the present disclosure.
Figure 11:
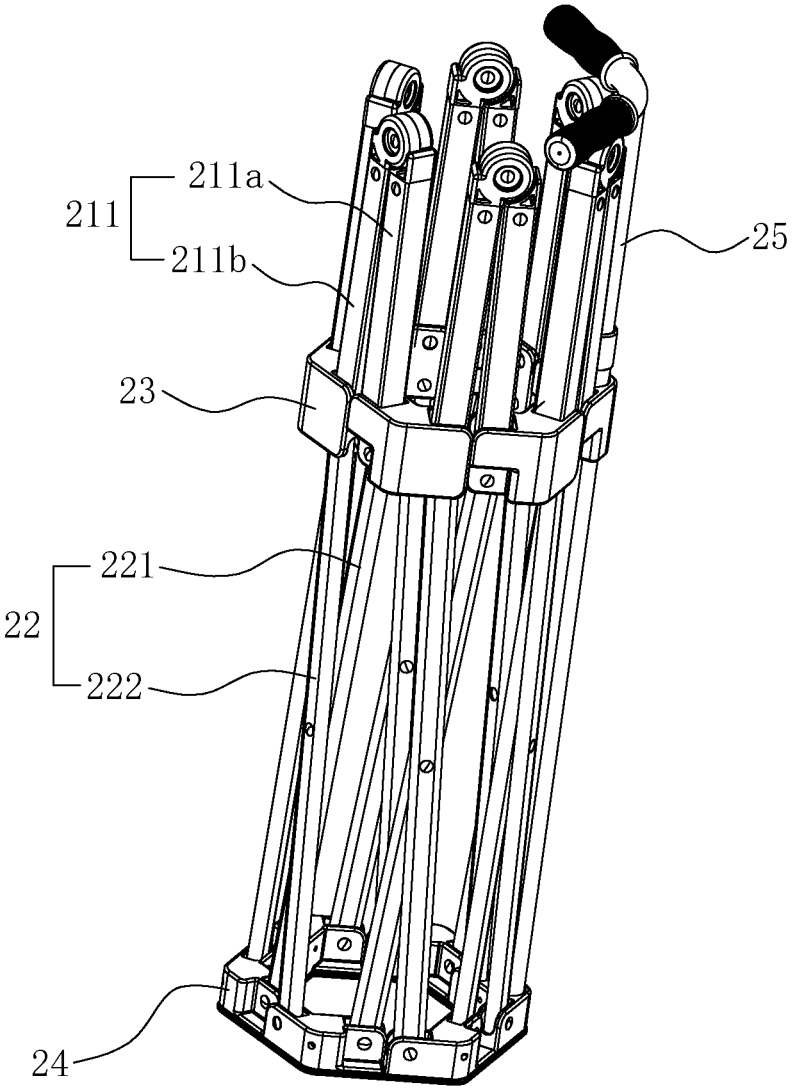
FIG. 11 is a space diagram of a foldable bed frame in a folded state according to the present disclosure.

As illustrated in FIGS. 1-11, the trampoline of the present disclosure includes a jumping surface 1 and a foldable bed frame 2, where the foldable bed frame 2 includes a frame body 21 formed by a plurality of side rods 211 in a surrounding manner, and a support assembly 22 arranged below each of the side rods 211.

A connecting base 23 is arranged between two adjacent side rods 211, and each of the side rods 211 includes two section rods 211*a* and 211*b*, where proximal ends of the two section rods 211*a* and 211*b* are pivotally connected to each other, and distal ends of the two section rods 211*a* and 211*b* are pivotally connected to corresponding connecting bases 23 respectively.

A supporting base 24 is arranged below each of the connecting bases 23, and preferably, the supporting base 24 is located directly below one corresponding connecting base 23.

Each of the support assemblies 22 includes two support rods 221 and 222 that are pivotally connected in an X-shaped and crossed manner, upper ends of the two support rods 221 and 222 are pivotally connected to corresponding connecting bases 23 respectively, and lower ends of the two support rods 221 and 222 are pivotally connected to corresponding supporting bases 24 respectively.

The jumping surface 1 is located inside the frame body 21, and peripheral edges of the jumping surface 1 are connected to the frame body 21 through a plurality of connecting members 3. More specifically, the peripheral edges of the jumping surface 1, through the plurality of connecting members 3, are connected to the two section rods 211*a* and 211*b* of each of the side rods 211, where the connecting members 3 can have an elastic rope structure.

When the foldable bed frame 2 is folded, the proximal ends of the two section rods 211*a* and 211*b* of each of the side rods 211 move upward, the distal ends of the two section rods 211*a* and 211*b* of each of the side rods 211 move closer to each other, and the two support rods 221 and 222 of each of the support assemblies 22 also move closer to each other. Further, when the distal ends of the two section rods 211*a* and 211*b* of each of the side rods 211 move closer to each other, the two section rods 211*a* and 211*b* of each of the side rods 211 and the two support rods 221 and 222 of each of the support assemblies 22 also move toward a center C of the trampoline, and the jumping surface 1 and the connecting members 3 are folded inward.

The foldable bed frame 2 further includes at least one handrail rod 25, a lower end of the handrail rod 25 is detachably inserted into one corresponding set of the connecting base 23 and the supporting base 24, and a handrail 251 is arranged at an upper end of the handrail rod 25. The handrail 251 allows a user (particularly a child or a beginner) to hold when jumping on the trampoline, and the handrail rod 25 has a telescopic rod structure, such that a height of the handrail 251 can be adjusted to meet use needs of users of different heights.

Because the handrail rod 25 is inserted into the corresponding set of the connecting base 23 and the supporting base 24, and also because the corresponding set of the connecting base 23 and the supporting base 24 follows the corresponding section rod 211*a* or 211*b* and the corresponding support rod 221 or 222 to a folded position when the foldable bed frame 2 is folded, the handrail rod 25 can also reach the corresponding folded position, such that it is not required to remove the handrail rod 25 when the trampoline is folded.

In a preferred embodiment of the present disclosure, the frame body 21 is a regular polygon frame body formed by a plurality of equal-length side rods 211 in a surrounding manner. Further, a pivot connection position A1 between the proximal ends of the two section rods 211*a* and 211*b* of each of the side rods 211 is aligned vertically with a pivot connection position B1 between the two support rods 221 and 222 of one corresponding support assembly 22, and pivot connection positions A2 and A3 of the distal ends of the two section rods 211*a* and 211*b* of each of the side rods 211 are aligned vertically with pivot connection positions B2 and B3 for upper ends of and pivot connection positions B4 and B5 for lower ends of the two support rods 221 and 222 of one corresponding support assembly 22 respectively.

In a preferred embodiment of the present disclosure, a supporting plane 240 suitable for contact with the ground is arranged at a bottom of each of the supporting bases 24, and the trampoline is placed on the ground through each of the supporting planes 240.

In a preferred embodiment of the present disclosure, the two section rods 211*a* and 211*b* of each of the side rods 211 are line-shaped when they are unfolded. The two section rods 211*a* and 211*b* of each of the side rods 211 are defined as a first section rod 211*a* and a second section rod 211*b* respectively, where one end of the first section rod 211*a* close to the second section rod 211*b* is provided with a first pivot connection piece 26, and one end of the second section rod 211*b* close to the first section rod 211*a* is provided with a second pivot connection piece 27.

The first pivot connection piece 26 includes a first inserted connection portion 261 that is inserted into and fixedly connected to an end portion of the first section rod 211*a*, a first circular pivot connection portion 262 exposed outside the end portion of the first section rod 211*a*, a first arc-shaped concave portion 263 that is located on a side of the first circular pivot connection portion 262 close to the first inserted connection portion 261 and extends outward in an axial direction of the first circular pivot connection portion 262, a first sector-shaped limiting block 264 that is arranged on an outer surface of the first circular pivot connection portion 262 in a protruding manner and is close to the first arc-shaped concave portion 263, and a first sector-shaped limiting groove 265 that is concavely formed on the outer surface of the first circular pivot connection portion 262 and is away from the first arc-shaped concave portion 263. One end of the first sector-shaped limiting groove 265 is provided with a vertical first end wall 2651, and the other end of the first sector-shaped limiting groove 265 is provided with a horizontal second end wall 2652.

The second pivot connection piece 27 includes a second inserted connection portion 271 that is inserted into and fixedly connected to an end portion of the second section rod 211*b*, a second circular pivot connection portion 272 that is exposed outside the end portion of the second section rod

211*b* and arranged with the first circular pivot connection portion 262 in a staggered manner, a second arc-shaped concave portion 273 that is located on a side of the second circular pivot connection portion 272 close to the second inserted connection portion 271 and extends inward in an axial direction of the second circular pivot connection portion 272, a second sector-shaped limiting block 274 that is arranged on an inner surface of the second circular pivot connection portion 272 in a protruding manner and is close to the second arc-shaped concave portion 273, and a second sector-shaped limiting groove 275 that is concavely formed on the inner surface of the second circular pivot connection portion 272 and is away from the second arc-shaped concave portion 273. One end of the second sector-shaped limiting groove 275 is provided with a vertical third end wall 2751, and the other end of the second sector-shaped limiting groove 275 is provided with a horizontal fourth end wall 2752.

The first circular pivot connection portion 262 and the second circular pivot connection portion 272 are arranged side by side and pivotally connected through a pin 28, the first arc-shaped concave portion 263 is slidably fitted with an outer circular surface of the second circular pivot connection portion 272, and the second arc-shaped concave portion 273 is slidably fitted with an outer circular surface of the first circular pivot connection portion 262. The first sector-shaped limiting block 264 is inserted into and slidably matched with the second sector-shaped limiting groove 275, and the second sector-shaped limiting block 274 is inserted into and slidably matched with the first sector-shaped limiting groove 265.

When the two section rods 211*a* and 211*b* of each of the side rods 211 are unfolded, the first arc-shaped concave portion 263 slides to an upper side of the outer circular surface of the second circular pivot connection portion 272, the second arc-shaped concave portion 273 slides to an upper side of the outer circular surface of the first circular pivot connection portion 262, the first sector-shaped limiting block 264 slides to a position where its top abuts against the third end wall 2751, and the second sector-shaped limiting block 274 slides to a position where its top abuts against the first end wall 2651, such that the two section rods of each of the side rods are line-shaped.

When the two section rods 211*a* and 211*b* of each of the side rods 211 are folded, the first arc-shaped concave portion 263 slides to a lower side of the outer circular surface of the second circular pivot connection portion 272, the second arc-shaped concave portion 273 slides to a lower side of the outer circular surface of the first circular pivot connection portion 262, the first sector-shaped limiting block 264 slides to a position where its top abuts against the fourth end wall 2752, and the second sector-shaped limiting block 274 slides to a position where its top abuts against the second end wall 2652.

Further, the first circular pivot connection portion 262, the first arc-shaped concave portion 263, the first sector-shaped limiting block 264, and the first sector-shaped limiting groove 265 are concentrically arranged, the first sector-shaped limiting block 264 and the first arc-shaped concave portion 263 are parallel to each other, the first sector-shaped limiting groove 265 is arranged relative to the first sector-shaped limiting block 264, a central angle of the first sector-shaped limiting block 264 is 90 degrees, and a central angle of the first sector-shaped limiting groove 265 is 270 degrees. The second circular pivot connection portion 272, the second arc-shaped concave portion 273, the second sector-shaped limiting block 274, and the second sector-shaped limiting groove 275 are also concentrically arranged, the second sector-shaped limiting block 274 and the second arc-shaped concave portion 273 are parallel to each other, the second sector-shaped limiting groove 275 is arranged relative to the second sector-shaped limiting block 274, a central angle of the second sector-shaped limiting block 274 is 90 degrees, and a central angle of the second sector-shaped limiting groove 275 is 270 degrees.

In a preferred embodiment of the present disclosure, two first pivot connection grooves 232 are symmetrically formed on both sides of an upper end of each of the connecting bases 23, and the two first pivot connection grooves 232 are configured for pivotally connecting end portions of the corresponding section rods 211*a* and 211*b*. In the two support rods 221 and 222 of each of the support assemblies 22, one support rod 221 is located on a relatively inner side, and the other support rod 222 is located on a relatively outer side. Both sides of a lower end of each of the connecting bases 23 are provided with a second pivot connection groove 233 inwardly arranged and a third pivot connection groove 234 outwardly arranged, where the second pivot connection groove 233 is configured for pivotally connecting an upper end of the corresponding support rod 221 located on the relatively inner side, and the third pivot connection groove 234 is configured for pivotally connecting an upper end of the corresponding support rod 222 located on the relatively outer side. Both sides of each of the supporting bases 24 are provided with a fourth pivot connection groove 242 inwardly arranged and a fifth pivot connection groove 243 outwardly arranged, where the fourth pivot connection groove 242 is configured for pivotally connecting a lower end of the corresponding support rod 221 located on the relatively inner side, and the fifth pivot connection groove 243 is configured for pivotally connecting a lower end of the corresponding support rod 222 located on the relatively outer side.

As described above, a folding process of the trampoline according to the present disclosure is as follows: first, each of the side rods 211 is lifted upward to pre-fold each of the side rods 211 upward slightly, i.e., the proximal ends of the two section rods 211*a* and 211*b* of each of the side rods 211 move upward slightly, then the entire foldable bed frame 2 is pushed inward to fold and retract the frame body 21 inward together with all the support assemblies 22, the jumping surface 1, the connecting members 3 and the handrail rod 25.

The above described embodiments are merely preferred embodiments of the present disclosure, and the scope of implementations of the present disclosure shall not be defined thereby, that is, all simple equivalent changes and modifications made with respect to the patent scope and the description of the present disclosure shall fall within the scope of the present disclosure.

The invention claimed is:

1. A trampoline, comprising: a foldable bed frame, the foldable bed frame comprising:

a frame body formed by a plurality of side rods in a surrounding manner, each side rod of the plurality of side rods formed by two section rods including a first section rod and a second section rod, each of the first section rod and the second section rod having a proximal end and a distal end, the proximal end of each first section rod is provided with a first pivot connection piece, and the proximal end of each second section rod is provided with a second pivot connection piece, wherein for each side rod, the proximal end of the first section rod is pivotally connected to the proximal end of the second section rod;

a connecting base arranged between every two adjacent side rods, wherein for each side rod the distal end of the first section rod and the distal end of the second section rod are pivotally connected to a corresponding connecting base;

a support assembly arranged below each side rod of the plurality of side rods; each of the support assemblies comprising two support rods pivotally connected to each other in an X-shaped cross manner, wherein upper ends of the two support rods of each of the support assemblies are pivotally connected to corresponding connecting bases, respectively; and a supporting base arranged below each of the connecting bases, wherein lower ends of the two support rods of each of the support assemblies are pivotally connected to corresponding supporting bases, respectively; and a jumping surface located inside the frame body, wherein peripheral edges of the jumping surface are connected to the frame body through a plurality of connecting members, wherein when the foldable bed frame is being folded, the proximal ends of the first and second section rods of each side rod of the plurality of side rods move upward, the distal ends of the first and second section rods of each side rod of the plurality of side rods move closer to each other, and the two support rods of each of the support assemblies also move closer to each other at the upper ends and the lower ends, such that the first and second section rods of each side rod of the plurality of side rods and the two support rods of each of the support assemblies move toward a center of the trampoline, and the jumping surface and the plurality of connecting members are folded inward, wherein the two section rods of each side rod of the plurality of side rods are line-shaped when they are unfolded, wherein the first pivot connection piece at the proximal end of each first section rod comprises a first inserted connection portion that is inserted into and fixedly connected to of the proximal end of the corresponding first section rod, a first circular pivot connection portion exposed outside the proximal end of the corresponding first section rod, a first arc-shaped concave portion that is located on a side of the first circular pivot connection portion close to the first inserted connection portion and extends outward in an axial direction of the first circular pivot connection portion, a first sector-shaped limiting block that is arranged on an outer surface of the first circular pivot connection portion in a protruding manner and is close to the first arc-shaped concave portion, and a first sector-shaped limiting groove that is concavely formed on the outer surface of the first circular pivot connection portion and is away from the first arc-shaped concave portion, wherein one end of the first sector-shaped limiting groove is provided with a vertical first end wall, and the other end of the first sector-shaped limiting groove is provided with a horizontal second end wall, wherein the second pivot connection piece at the proximal end of each second section rod comprises a second inserted connection portion that is inserted into and fixedly connected to of the proximal end of the corresponding second section rod, a second circular pivot connection portion that is exposed outside the proximal end of the corresponding second section rod and arranged with the first circular pivot connection portion in a staggered manner, a second arc-shaped concave portion that is located on a side of the second circular pivot connection portion close to the second inserted connection portion and extends inward in an axial direction of the second circular pivot connection portion, a second sector-shaped limiting block that is arranged on an inner surface of the second circular pivot connection portion in a protruding manner and is close to the second arc-shaped concave portion, and a second sector-shaped limiting groove that is concavely formed on the inner surface of the second circular pivot connection portion and is away from the second arc-shaped concave portion, wherein one end of the second sector-shaped limiting groove is provided with a vertical third end wall, and the other end of the second sector-shaped limiting groove is provided with a horizontal fourth end wall, wherein the first circular pivot connection portion and the second circular pivot connection portion are staggered side by side and pivotally connected to each other through a pin, the first arc-shaped concave portion is slidably fitted with an outer circular surface of the second circular pivot connection portion, and the second arc-shaped concave portion is slidably fitted with an outer circular surface of the first circular pivot connection portion, wherein the first sector-shaped limiting block is inserted into and slidably matched with the second sector-shaped limiting groove, and the second sector-shaped limiting block is inserted into and slidably matched with the first sector-shaped limiting groove, wherein when the two section rods of each of the side rods are folded, the first arc-shaped concave portion slides to a lower side of the outer circular surface of the second circular pivot connection portion, the second arc-shaped concave portion slides to a lower side of the outer circular surface of the first circular pivot connection portion, the first sector-shaped limiting block slides to a position where its top abuts against the fourth end wall, and the second sector-shaped limiting block slides to a position where its top abuts against the second end wall.

2. The trampoline according to claim 1, wherein the frame body is a polygon frame body formed by a plurality of equal-length side rods in a surrounding manner.

3. The trampoline according to claim 1, wherein a supporting plane configured to contact the ground is arranged at a bottom of each of the supporting bases.

4. The trampoline according to claim 1, wherein a pivot connection position between the proximal ends of the first and second section rods of each side rod of the plurality of side rods is aligned vertically with a pivot connection position of the two support rods of a corresponding support assembly pivotally connected to each other in the X-shaped cross manner.

5. The trampoline according to claim 1, wherein pivot connection positions of the distal ends of the first and second section rods of each side rod of the plurality of side rods are aligned vertically with pivot connection positions for the upper ends of and pivot connection positions for the lower ends of the two support rods of one corresponding support assembly respectively.

6. The trampoline according to claim 1, wherein the first circular pivot connection portion, the first arc-shaped concave portion, the first sector-shaped limiting block, and the first sector-shaped limiting groove are concentrically arranged, the first sector-shaped limiting block and the first arc-shaped concave portion are parallel to each other, the first sector-shaped limiting groove is arranged relative to the first sector-shaped limiting block, a central angle of the first sector-shaped limiting block is 90 degrees, and a central angle of the first sector-shaped limiting groove is 270 degrees, and wherein the second circular pivot connection portion, the second arc-shaped concave portion, the second sector-shaped limiting block, and the second sector-shaped limiting groove are also concentrically arranged, the second sector-shaped limiting block and the second arc-shaped concave portion are parallel to each other, the second sector-shaped limiting groove is arranged relative to the second sector-shaped limiting block, a central angle of the second sector-shaped limiting block is 90 degrees, and a central angle of the second sector-shaped limiting groove is 270 degrees.

7. The trampoline according to claim 1, wherein two first pivot connection grooves are symmetrically formed on both sides of an upper end of each of the connecting bases, and the two first pivot connection grooves are configured for pivotally connecting the adjacent side rods, wherein both sides of a lower end of each of the connecting bases are provided with a second pivot connection groove inwardly arranged and a third pivot connection groove outwardly arranged, and both sides of each of the supporting bases are provided with a fourth pivot connection groove inwardly arranged and a fifth pivot connection groove outwardly arranged, and wherein each of the second pivot connection groove and the third pivot connection groove is configured for pivotally connecting one of the upper ends of the corresponding support rods, and each of the fourth pivot connection groove and the fifth pivot connection groove is configured for pivotally connecting one of the lower ends of the corresponding support rods.

8. The trampoline according to claim 1, wherein the foldable bed frame further comprises at least one handrail rod, a lower end of the handrail rod is detachably inserted into one corresponding set of the connecting base and the supporting base, and a handrail is arranged at an upper end of the handrail rod, wherein the handrail rod has a telescopic rod structure.

* * * * *